US006276955B1

(12) United States Patent
Hollesen et al.

(10) Patent No.: US 6,276,955 B1
(45) Date of Patent: Aug. 21, 2001

(54) MULTI CONTACT SOCKET CONNECTOR

(75) Inventors: David B. Hollesen, Belle Mead, NJ (US); Ivan Pawlenko, Holland, PA (US); Thelma E. Cole, Neshamic Station, NJ (US); Jason A. Kay, Morristown, NJ (US); David S. Kerr, Mendham, NJ (US); Walter Pelosi, Randolf, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/480,967

(22) Filed: Jan. 14, 2000

(51) Int. Cl.[7] ..... H01R 4/24
(52) U.S. Cl. ..... 439/441; 439/439
(58) Field of Search ..... 439/439, 440, 439/441, 459, 775, 876, 874, 824, 842, 856, 857

(56) References Cited

U.S. PATENT DOCUMENTS 3,079,577 * 2/1963 Brownfield ..... 439/55
3,210,719 * 10/1965 Graeff ..... 439/439
3,528,173 * 9/1970 Gall ..... 29/839
3,670,409 * 6/1972 Reimer ..... 29/853
5,152,702 * 10/1992 Pilny ..... 439/876
5,275,620 * 1/1994 Darby et al. ..... 607/1
5,711,596 * 1/1998 Hoover et al. ..... 362/226
6,080,008 * 6/2000 Frantz ..... 439/441
6,113,421 * 9/2000 Daoud ..... 439/459
6,128,181 * 10/2000 Higami et al. ..... 361/600

* cited by examiner

*Primary Examiner*—Tulsidas Patel
(74) *Attorney, Agent, or Firm*—Woodbridge & Associates; Richard C. Woodbridge

(57) ABSTRACT

An insulation displacement contact (IDC) strain relief cap to interconnect a wire with an electrical contact is disclosed. The strain relief cap has a "U" shaped end to engage and retain the wire and is engageable with the contact. Means in the form of two star shaped openings are provided on the strain relief cap to retain the wire whereby the electrical contact, wire, and strain relief cap may be moved as a single unit. The star shaped openings and "U" shaped member allow for flexible retention of the wire to the strain relief cap.

14 Claims, 2 Drawing Sheets

MULTI CONTACT SOCKET CONNECTOR

BACKGROUND OF THE INVENTION

1. Field of the Invention

This invention relates to an electrical connector for insulation displacement contact (IDC) with insulation conducting wire. The invention finds particular utility in telecommunications where wires terminate in central office and building entrances.

2. Description of Prior Art

It is common to find the use of insulation displacement contact (IDC) technology in the electrical connector industry, because it allows rapid and simple connection of conducting wires to terminals without stripping nor crimping. A typical IDC connection is made by disposing an insulated conducting wire perpendicular to a planar wall portion comprising an IDC slot, stuffing a wire into the slot such that edges thereof cut through the insulation and make electrical contact with conducting strands of a wire. The IDC slots are generally formed by opposed edges of the sheet metal wall portion which is necessarily of a certain width to have sufficient strength to support the contact pressure against the edges.

Commercially available connectors that utilize insulation displacement contact (IDC) technology provide strain relief for multiple conductors. IDC pins are molded into the connector body which is used to support the strain relief member. These commercially available connectors are designed to terminate multiple conductors in a single connector. Strained relief for these types of connectors are designed as an integral part of the connector body securing all conductors within a single strain relief member. Although this technology finds particular applicability when multiple wires are to be connected and unconnected, it does not lend itself to large pin array connectors where individual wires need to be reworked or rerouted without jeopardizing adjacent connections. Strain relief of the individual contacts or pins provide a great benefit during reworking or rerouting of individual wires.

SUMMARY OF THE INVENTION

It is a primary object of the present invention to provide strain relief for individual IDC pins or contacts.

It is another object of the invention to provide individual strain relief pins that make IDC a viable technology for large pin array connectors.

A further object of the invention is to provide strain relief for individual pins or contacts to allow for automated assembly of large pin arrays.

Yet a further object of the invention is to provide strain relief for individual IDC connections to ensure robust electrical connections, while allowing wiring changes and repairs without compromising adjacent electrical connections.

It is yet another object of the invention to provide strain relief for individual IDC pins or contacts to replace wire wrap technology on current products.

The foregoing objects have been accomplished by providing an IDC strain relief cap that operates in conjunction with an IDC contact to retain an insulated wire rigidly in contact with the cap and contact.

DETAILED DESCRIPTION OF THE INVENTION

Figure 1:
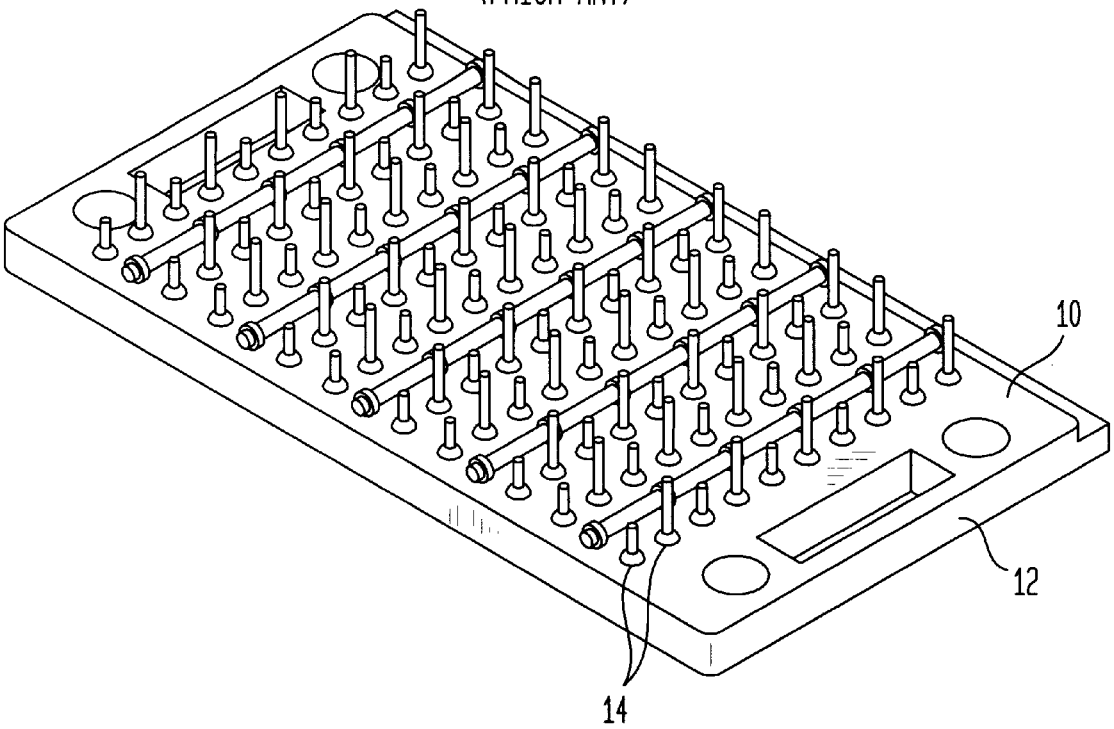
FIG. 1 (PRIOR ART)
FIG. 1 is an isometric back view of a current projection block having wire wrap pins.
Figure 2:
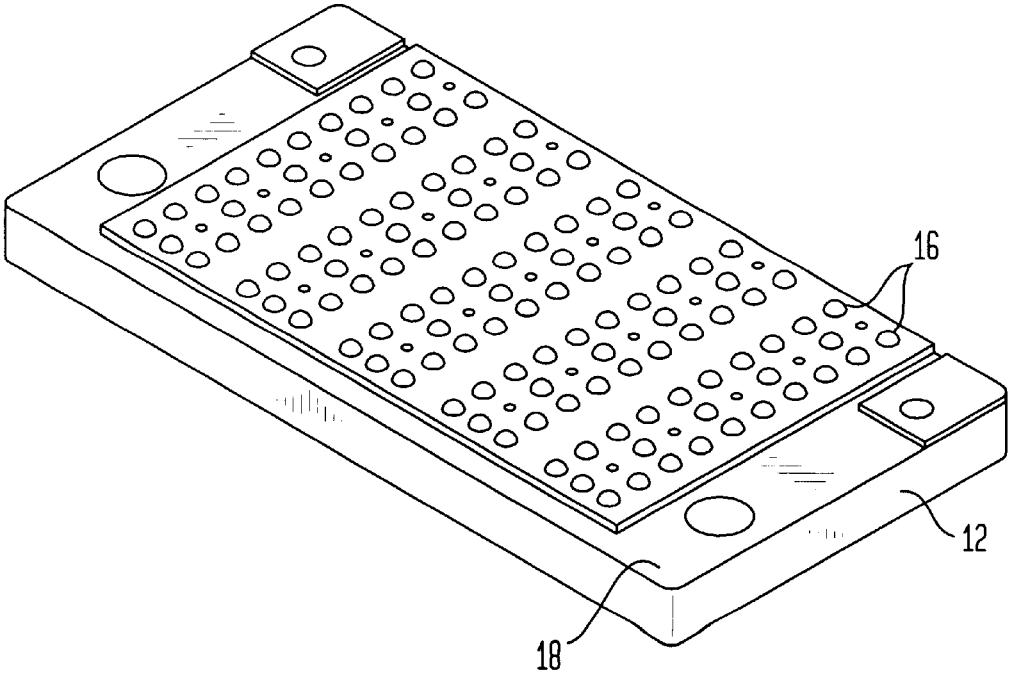
FIG. 2 (PRIOR ART)
FIG. 2 is an isometric front view of a current projection block having wire wrap pins.

FIG. 1. Illustrates the back 10 of a relatively standard protection block 12 with wire wrap pins 14 projecting through cylindrical openings 16 (FIG. 2) on the front 18 of block 12. In the prior art, wire not shown, is wrapped in a spiral fashion around the pins 14 to provide contact. As described later in the specification, the disclosure of the present invention can make use of protection block 12.

Figure 3:
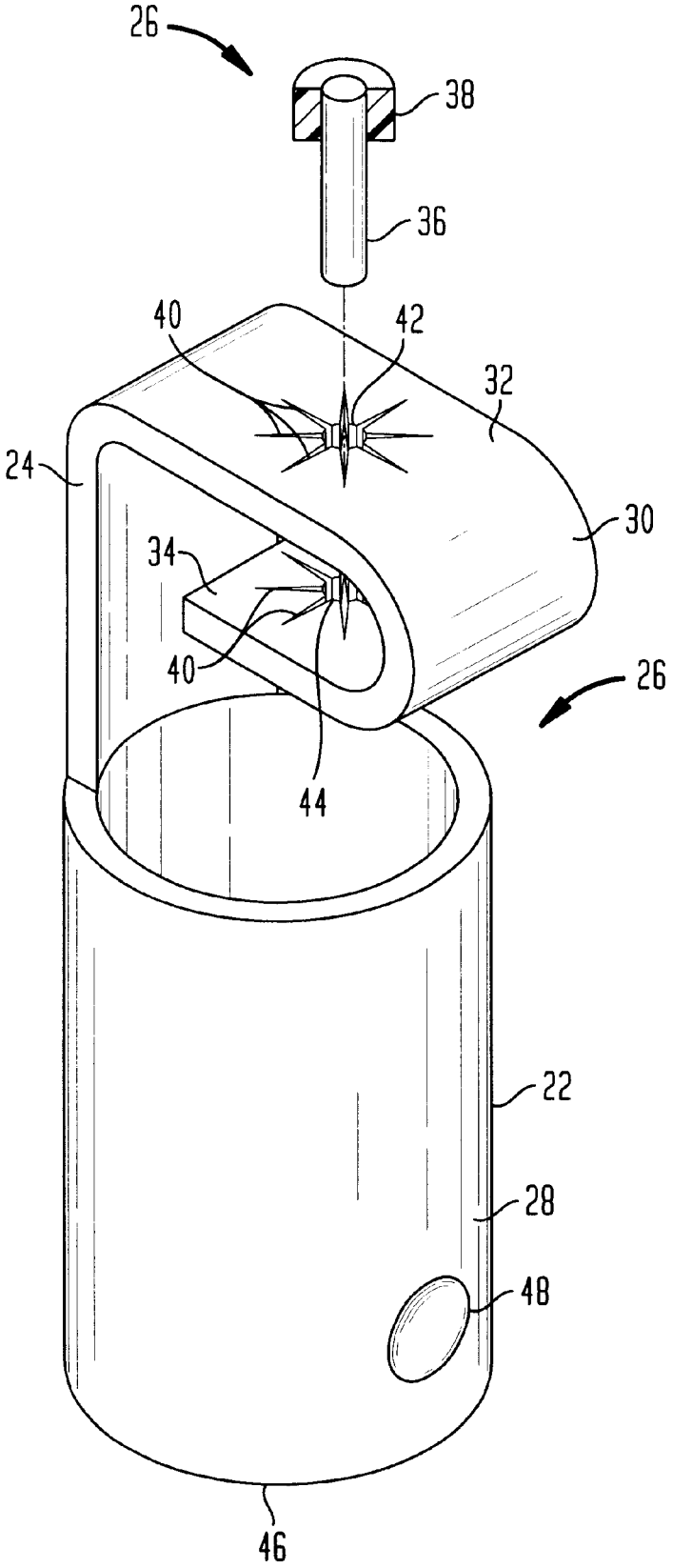
FIG. 3 is an enlarged view of an IDC connection according to the disclosure.

FIG. 3 illustrates an IDC pin and strain relief cap assembly 20 having an IDC contact 22 terminating at one end in a retainer clip 24 that is engageable with a wire 26. IDC contact 22 includes a cylindrical hollow body portion 28 having a significant length to engage and be retained by a pin 14 on protection block 12. Opposite from body portion 28 of IDC contact 22, retaining clip 24 includes a "U" shaped end 30 having upper and lower plate like portions 32 and 34 that are movable relative to each other to grasp and retain wire 26. Wire 26 is of a type commonly used to transmit electricity or signals and includes a center portion 36 made, for example, of solid copper that is surrounded by appropriate insulation 38 to protect center portion 36 from the exterior environment.

In the center of each plate 32 and 34 of the "U" shaped end 30 is a hole with, for example, eight slots 40 extending out from the center forming a star like pattern. Hole 42 in upper plate 32 is axially aligned with hole 44 in lower plate 34. The star shaped holes 42 and 44 are of a smaller diameter than the outside diameter of center portion 36 of wire 26 to insure a tight grip on the center portion. IDC contact 22 is preferably made of a standard metal material such as a steel alloy coated with brass to transmit electrical signals or electricity to the pins 14.

In assembly, the wire 26 is inserted straight through the two star shaped holes 42 and 44. Since the star shaped holes are of a smaller diameter than the outside diameter of center section 36 or wire 26 the slots 40 allow for the metal between adjacent slots to slightly deform bending in the direction of wire movement and thereby gripping tightly center section 36 of wire 26. This contact between metal alloy of upper and lower plates 32 and 34 with the copper or softer center section 36 insures both good electrical connection and stain relief without additional hardware or assembly processes. The downward movement in FIG. 3, of the metal between the slots 40 provides a self locking connection, that can be applied to individual pins or contacts. This type of connection will provide both good electrical and mechanical characteristics and facilitate cost effective automated assembly.

It should be recognized by those skilled in the art that although holes 42 and 44 are shown as star shaped openings with eight (8) slots each, changes to the configuration of these openings may be made within the spirit of this invention. For example, 6, 7 or 9 slots equally spaced may be provided. The significance of the slots is to allow for deformation in a flexible manner for metal between the slots to move in response to the insertion of center section 36 into the openings 42 and 44. Further it is preferred to have 360 degree contact between both upper late 32 and lower plate 34 with center section 36. It should be recognized, that this 360 degree contact may be intermittent as illustrated in the drawings and explained within the specification.

Further, the alignment of holes 42 and 44 insure rapid straight placement of wire 26 relative to IDC contact 22. If desired, these holes 42 and 44 may be offset relative to the axis of hollow body portion 28. Further it should be recognized that "U" shaped member 30 with movable upper and lower plates 32 and 34 provides further gripping action of wire 26. For example, when center section 36 is inserted into opening 42 and then subsequently inserted into opening 44 lower plate 34 may flex relative to upper plate 32 at a slight angle. This slight flexure upon the insertion of center section 36 in opening 44 will provide additional retention of wire 26 in retainer clip 24.

In the preferred embodiment strain relief assembly 20 is made of a single piece of stamped sheet metal which is subsequently formed at its lower end into hollow body portion 28 and bent at its upper end into the "U" shaped end portion 30. Prior to formation, the stamped metal may have holes 42 and 44 with the respective slots 40 punched into the stamp plate. In this manner the strain relief cap assemblies 20 may be rapidly and consistently produced from a single strip of metal.

Further, end 46 of IDC contact 22 may be constructed in a known manner to be engaged with or disengaged from a pin 14 in a rapid manner when it is necessary to change contact points for the wires 28 relative to the pins 14 on block 12. Retention means in the form of an annular indentation 48 on end 46 can be used for this purpose.

It can also be seen from FIG. 3, that in a preferred embodiment, the upper and lower plates 32 and 34 lie in an imaginary extension of cylindrical hollow body portion 28. This location adds to a reduction in size of contact 22 as well as support for the "U" shaped member 30 during movement of body portion 28 over a pin 14. Additionally, center portion 38 of wire 26 may move within body portion 28 reducing the possibility of making electrical contact with other contacts in a tight pin array in block 12.

What is claimed is:

1. An IDC strain relief cap assembly, with an electrical contact, to interconnect a wire, with an electrical conductor, said assembly comprising:

a. a protective block having a plurality of spaced, cylindrically shaped pins; and b. a metal IDC contact having:

(i) a first end having a hollow cylindrically shaped portion to engage one of said cylindrically shaped pins on said block to retain said IDC contact relative to said block, (ii) a second end defining a "U" shaped end having:

(a) upper and lower plate shaped portions aligned axially relative to said hollow cylindrically shaped portion, (b) a hole in said upper plate shaped portion having a diameter less than said electrical conductor and a plurality of circumferentially spaced slots extending out from the center of said hole to form a star shaped pattern, and (c) a hole in said lower plate shaped portion having a diameter less than said electrical conductor and a plurality of circumferentially spaced slots extending out from the center of said hole to form a star shaped pattern, said holes in said upper and lower plate shaped portions being generally axially aligned.

2. An assembly according to claim 1 further comprising a wire having an electrical conductor of a diameter that is greater than the diameter of said holes in said upper and lower plate shaped portions said electrical conductor projecting through said holes to deform the plate shaped material around said holes that lies in between adjacent slots to thereby retain said electrical conductor relative to said contact.

3. An assembly according to claim 1 wherein said "U" shaped member lies substantially within an imaginary extension of said cylindrical hollow body portion.

4. An assembly according to claim 3 wherein said holes in said upper and lower plates are generally axially aligned with the axis of said cylindrical hollow body portion.

5. An assembly according to claim 3 wherein said "U" shaped member extends upwardly away from said cylindrical hollow body portion, then outwardly over said cylindrical hollow body portion defining one of said plate like portions and then back upon itself in a spaced relationship to said one plate like member to define the other of said plate like members.

6. An assembly according to claim 5 wherein said one plate like portion is said upper portion and said other plate like portion is said lower portion.

7. An IDC strain relief cap assembly, with an electrical contact, to interconnect a wire having an electrical conductor said assembly comprising:

a. a first end;

b. means to engage and make electrical contact between said first end and said electrical contact;

c. a second end; and d. a "U" shaped member on said second end having contiguous spaced upper and lower plate shaped portions movable relative to each other by means of the "U" shaped connection, each of said plate shaped portions having a star shaped hole of a smaller diameter than the outside diameter of the electrical conductor of said wire, each of said star shaped holes being defined by a relative cylindrical portion having a plurality of circumferentially spaced radially extending slots.

8. The assembly of claim 7, wherein said holes in said upper and said lower plate shaped portions are generally axially aligned to allow the electrical conductor of said wire to be inserted straight through the two star shaped holes.

9. The assembly of claim 8, wherein said plurality of radially extending circumferentially spaced slots are of a significant number to allow for flexing of the material between adjacent slots of the respective upper and lower plate shaped portions during insertion of said electrical conductor of said wire within said holes.

10. The assembly of claim 9 wherein each star shaped hole includes eight (8) radially extending slots that are circumferentially spaced in equal increments around each of said respective holes.

11. The assembly of claim 7, wherein said first end, said means to engage, said second end and said "U" shaped member are a single piece of sheet metal.

12. The assembly of claim 11, wherein said first end is a cylindrical hollow body portion.

13. The assembly of claim 12 wherein said hole in said upper an lower plate shaped portions are generally axially aligned with the axis of said cylindrical hollow body portion.

14. The assembly of claim 13 wherein said upper and said lower plates lie within an imaginary extension of said cylindrical hollow body portion.

* * * * *